United States Patent [19]

Courtois

[11] 4,012,024

[45] Mar. 15, 1977

[54] KEY-JOINT FORMING DIVIDER STRIP WITH UPSTANDING SCREED ADAPTED FOR USE WITH CONCRETE SLABS

[75] Inventor: Peter D. Courtois, Oceanside, Calif.

[73] Assignee: Superior Concrete Accessories, Inc., Franklin Park, Ill.

[22] Filed: Feb. 3, 1976

[21] Appl. No.: 654,948

[52] U.S. Cl. ..... 249/9; 52/396; 249/3; 404/48; 404/50

[51] Int. Cl.[2] ..... E01C 11/04

[58] Field of Search ..... 249/2–7, 249/9, 208; 52/396, 699, 700, 703, 712, 714; 404/47–48, 50–56, 61, 62, 68

[56] References Cited

UNITED STATES PATENTS

| | | | |
|---|---|---|---|
| 2,848,929 | 8/1958 | Wilbur | 249/9 |
| 3,057,269 | 10/1962 | Artigalas et al. | 404/50 |
| 3,143,783 | 8/1964 | Gaetke | 404/51 |
| 3,497,172 | 2/1970 | Welch | 249/3 |
| 3,572,225 | 3/1971 | Burton | 404/47 |
| 3,628,764 | 12/1971 | Burton | 249/9 |

OTHER PUBLICATIONS

Burke Keyed Kold Joint Form; AIA File No. 4–D–2.

*Primary Examiner*—Ronald J. Shore
*Assistant Examiner*—John McQuade
*Attorney, Agent, or Firm*—Norman H. Gerlach

[57] ABSTRACT

A divider strip with an upstanding screed for use with a pouring of a pair of adjoining concrete slabs, such strip being designed to be supported by a horizontal series of laterally spaced stakes which are set below a predetermined grade level, and being adapted when in its operative position to have wet concrete poured on opposite sides thereof in order to form a pair of adjoining slabs with a key joint therebetween. A dual reentrant bend at the upper marginal portion of the strip establishes a downwardly facing locking channel for the upper ends of the stakes and also establishes an upstanding screed which extends upwardly to the grade level and is for the most part of single thickness.

2 Claims, 5 Drawing Figures

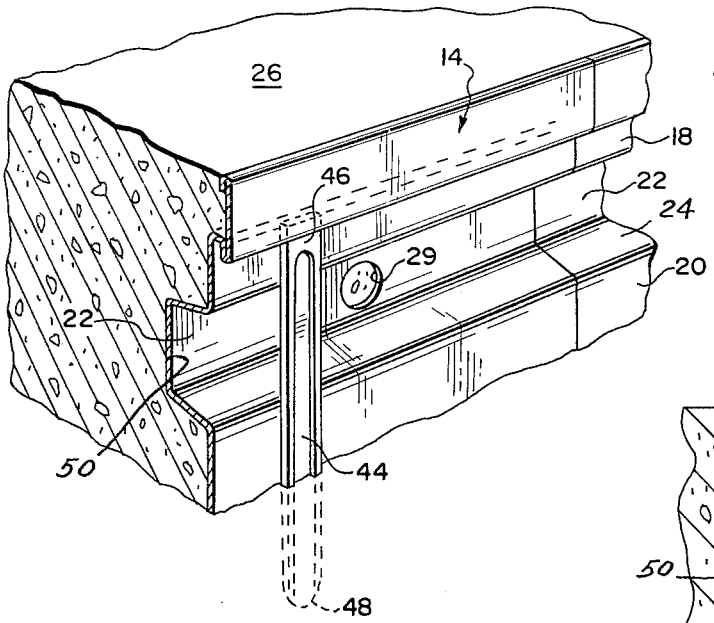
FIG. 1
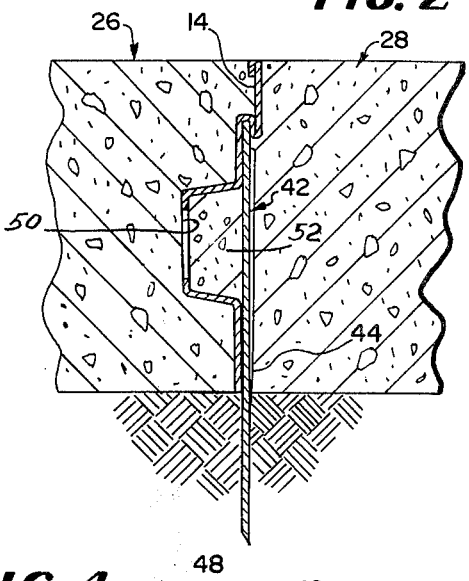
FIG. 2
FIG. 3
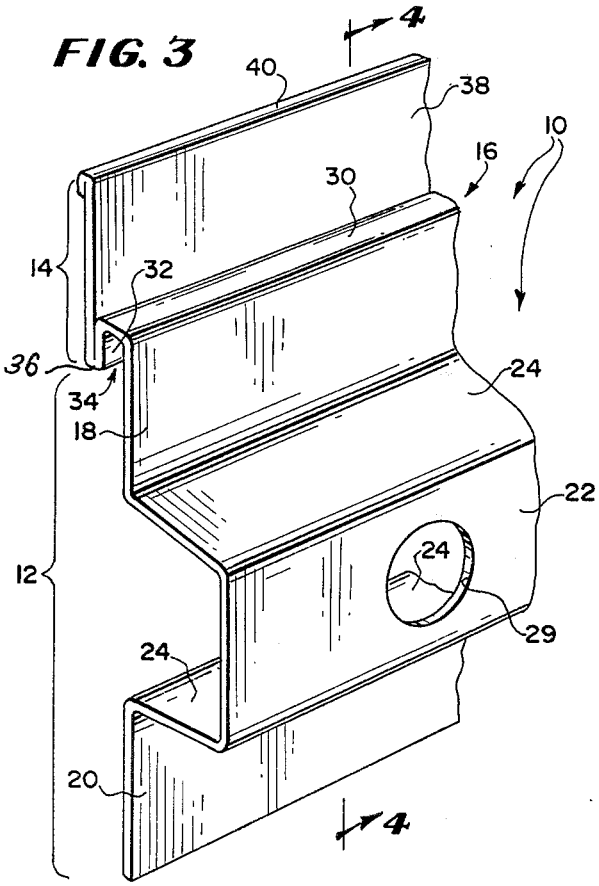
FIG. 4
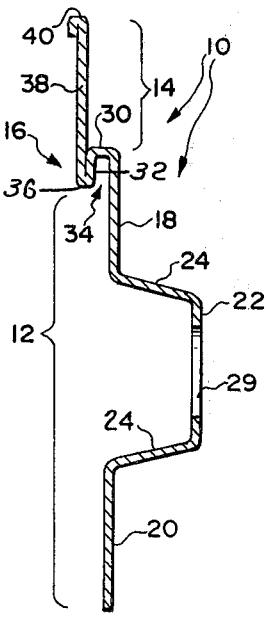
FIG. 5
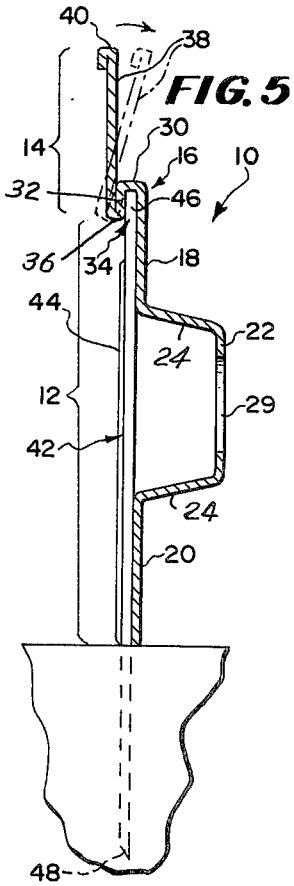

KEY-JOINT FORMING DIVIDER STRIP WITH UPSTANDING SCREED ADAPTED FOR USE WITH CONCRETE SLABS

The present invention relates to a screed-equipped key-joint forming divider strip which is preferably formed from sheet metal or the like and is used between adjacent slabs of poured concrete to form between slabs a tongue and groove type of interlocking key-joint which allows for expansion and contraction of the slabs due to change in temperature while at the same time preventing relative vertical displacement of the two slabs.

Key-joint forming divider strips of the general type to which this invention relates are widely used in the formation of concrete slabs for use in concrete roadways, building floors, airfield runways and the like. In general, previously designed key-joint forming strips are in the form of elongated sheet metal pieces, the lower regions of which are formed with coextensive laterally offset portions in order to establish the key-joint in the adjacent poured slabs, and the upper regions of which have folded over portions in order to form upstanding screeds which have horizontal linearly straight upper edges and are adapted to support screed boards in connection with concrete levelling operations. In between such lower and upper regions of the strips there are usually provided recesses, sockets or downwardly facing channels for reception of the upper ends of the stakes which are used in connection with the strips. The nature of such stake-receiving recesses, sockets or channels varies widely in connection with key-joint forming divider strips which currently are in use, as does the manner in which the upstanding screeds are formed in the strips, and various limitations and disadvantages are present in connection with both the stake-receiving and screed forming facilities of such strips.

One of the principal objects of the present invention is to provide a screed-equipped key-joint forming divider strip which is an improvement upon and has certain inherent advantages over the divider strips of U.S. Pat. Nos. 3,143,783, 3,288,042 and 3,357,324 and is characterized by the fact that it is lighter in weight and less costly to produce than such patented divider strips.

Another object of the invention is to provide a screed-equipped key-joint forming divider strip in which the dual reverse or reentrant juncture region between the upper screed section and the lower key-joint forming section is of unique and simple comstruction and the upstanding screed is for the most part of single thickness.

A further object of the invention is to provide a screed-equipped key-joint forming divider strip which is generally of new and improved construction and by way of its particular construction or design is capable of being readily applied to the upper ends of the associated horizontal row of spaced apart stakes.

Other objects of the invention and the various advantages and characteristics of the present divider strip will be apparent from a consideration of the foregoing detailed description.

The invention consists of the several novel features which will hereinafter be set forth and more particularly defined in the claims at the conclusion hereof.

In the accompanying single sheet of drawings forming a part of this specification, one illustrative embodiment of the invention is shown.

In these drawings:

FIG. 1 is a fragmentary perspective view, partly in section, showing the improved screed-equipped key-joint forming divider strip of the present invention operatively installed in a concrete slab formation, but with the slab-forming concrete on one side of the strip remaining unpoured;

FIG. 2 is a fragmentary vertical sectional view taken through the structure or installation of FIG. 1, but with both slabs being fully poured;

FIG. 3 is an enlarged fragmentary perspective view of the improved divider strip in its free state;

FIG. 4 is a vertical sectional view taken on the line 4—4 of FIG. 3 and in the direction of the arrows; and FIG. 5 is a sectional view similar to FIG. 4 but showing the divider strip of the present invention in position on one of its associated stakes.

Referring now to the drawings in detail, a screed-equipped key-joint forming divider strip embodying the principles of the present invention is designated in its entirety by the reference numeral 10 and it is preferably made from sheet metal, such, for example, as aluminum or steel, although it is contemplated that a suitable plastic material may be employed if desired. The strip 10 may be fabricated by effecting appropriate folds or bends in a sheet of metal or other flat blank of material or, alternatively, by an extruding operation.

The strip 10 involves in its general organization a lower key-joint forming section 12 (see FIGS. 3, 4 and 5), and an upper screed section 14, the two sections being integrally formed and connected together by a dual reverse or reentrant juncture region 16, the nature and function of which will be set forth in detail presently.

The lower key-joint forming section 12 consists of upper and lower vertical coplanar parts 18 and 20, and an intermediate offset part 22, the latter being connected to the parts 18 and 20 by integral parts 24 which converge in the direction of the offset part 22. The converging parts 24, together with the outwardly offset part 22, form a longitudinally extending channel or key deformation portion which is adapted to form a tongue and groove joint between the adjacent side faces of concrete slabs such as the slabs 26 and 28 which are poured on opposite sides of the divider strip 10 after installation of the latter as shown in FIG. 2, and the upper surfaces of which slabs establish a horizontal grade level after the concrete of which the slabs are formed has hardened. If desired, the intermediate offset part 22 may be provided with knock-out plugs or disks (not shown) which, when punched or pushed out, leave a number of longitudinally spaced holes or apertures 29 for reception therethrough of horizontally extending dowel or other rods (not shown) as is conventional in connection with key-joint forming divider strips of the character under consideration.

The arrangement of the lower key-joint forming section 12 of the divider strip 10 as heretofore described is wholly conventional and no claim is here made to any novelty therein, the novelty of the present invention residing rather in the nature, design and arrangement of the upper screed section 14 and of the dual reentrant juncture region 16 by means of which it is connected to the upper part 18 of the lower divider strip section 12 as will now be described in detail and subsequently claimed.

Still referring to FIGS. 3, 4 and 5 of the drawings, the dual reverse or reentrant juncture region 16 of the strip 10 is established by the provision of a laterally turned narrow flange 30 along the upper edge of the planar upper part 18 of the lower key-joint forming section 12, such flange terminating in a downturned flange 32, and the two flanges, in combination with the upper marginal region of the planar upper part 18, establishing an inverted or downwardly facing stake-receiving channel 34. The lower edge of the downturned flange 32 is turned or folded abruptly upwardly as indicated at 36, thus providing the aforementioned upper screed section 14 which, considered singly, is in the form of an elongated planar plate 38, the latter being for the most part of single thickness. The upper edge portion 40 of the screed-forming plate 38 is abruptly doubled back in a direction away from the offset part 22 of the lower key-joint forming section 12 in order that it is of double thickness for reinforcing or strengthening purposes and will offer a suitable surface adequately to support a screed bar (not shown).

The key-joint forming divider strip 10 of the present invention is adapted to be suspended on and supported by a straight horizontal row of spaced apart vertically extending stakes 42, one of which is shown in FIGS. 1, 2 and 5 of the drawings. Such stakes are of conventional construction and each is in the form of a vertically elongated steel or other metal member which is preferably provided with a longitudinally extending reinforcing or stiffening rib 44 and embodies a flat head portion 46 at its upper end and a point 48 at its lower end. It is contemplated that the stakes 42 will be driven into the ground to such an extent that their upper ends will be positioned uniformly and appreciably below the grade level which is established by the upper surfaces of the concrete slabs 26 and 28 which are yet to be poured. When the divider strip 10 is applied to the stakes 42, the flat head portions 46 extend snugly into the inverted or open bottom channel 34 as best shown in FIG. 5 and the lateral flange 30 of the reentrant function region 16 of the strip 10 seats upon the upper end surfaces of the stakes while the medial region of the stakes span the concave side of the strip as shown in FIGS. 1 and 2.

Installation of the strip 10 is made as shown in FIGS. 1, 2 and 5, the first step being to drive the stakes 42 along a surveyed line which defines an edge of the slab which is to be poured, the stakes being actually driven to a suitable depth to the end that their upper ends will be positioned uniformly below grade level. Thereafter, the divider strip 10 is applied to the stakes by manipulating it so as to cause the coextensive elongated inverted channel 34 at the juncture region between the screed section 14 and the key-joint forming section 12 to embrace the horizontally aligned upper head portions 46 of the stakes. Application of the inverted or open bottom channel 34 to the upper ends of the stakes after the latter have been first driven to the proper extent into the subgrade for the slabs 26 and 28 may be an entirely manual operation involving tamping of the divider strip 10 either on the upper doubled over edge 40 of the screed section 14 or on the laterally extending flange 30 which constitutes the bight portion of the channel 34. Alternatively, the application may be made by "opening up" of the channel 34 and this may conveniently be done without the aid of a tool by the simple expedient of flexing the screed plate 38 laterally with respect to the remainder of the strip as shown in dotted lines in FIG. 5, the flexing being in the direction of the offset part 22 and serving to cause the downturned or depending flange 32 to swing away from the wall-like planar part 18 thus widening the mouth of the channel 34 for easy reception of the upper head portions of the stakes 42. This flexing operation will preferably be carried out progressively from stake to stake by a partial flexing of the strip at the region where the inverted channel is applied to each individual stake. After the upper head portions of all of the stakes have thus been seized by the sides (upper plate like part 18 and downturned flange 32) of the channel 34, the application of some manual pressure to the strip 10 will assure seating of the bight portion (lateral flange) 30 of the channel on all of the aligned stake head portions, thus completing the necessary steps for subsequent concrete pouring operations.

Concrete pouring operations are preferably performed by pouring wet concrete on the male or convex side of the divider strip 10 in order to produce the slab 26 of FIGS. 1 and 2. When this is done, the pressure of the poured concrete will serve to press the divider strip 10 firmly against the stakes 42, while at the same time establishing a concrete key groove or slat 50 (see FIG. 2) in the adjacent side surface or edge portion of the poured and formed slab 26 as shown in FIGS. 1 and 2. Immediately after pouring of the slab 26, the slab 28 may be poured on the opposite or female (concave) side of the strip 10 and, when this is done, the concrete will flow into the aforementioned key groove 50 or slot of the strip and also in encompassing relation with the various stakes 42, thereby stabilizing the strip which is merely hung upon such stakes. This second pouring operation will establish on the adjacent side surface or edge portion of the slab 28 a concrete key 52 which registers with and projects into the key groove or slot 50.

Immediately after pouring of concrete on opposite sides of the divider strip 10 in order to form the slabs 26 and 28 a screeding or levelling operation will normally be resorted to in the usual manner. This is accomplished by resting a screed bar or rod in a horizontal position on the doubled over edge 40 of the screed section 14 of the strip and then moving the bar or rod back and forth over the upper surfaces of the two slabs 26 and 28 in order to effect truly level slab surfaces and effect clean edges when the concrete shrinks after hardening thereof.

It will be understood that the present divider strip 10 may be varied as to height in accordance with the desired depth of the concrete slabs undergoing formation. The stakes are driven into the ground or subgrade to such an extent that the height of the applied strip 10 is such that its lower edge touches or nearly touches the surface of the ground, the driving operation taking place without losing sight of the fact that the finally driven stakes must remain with their upper head portions 46 being disposed in horizontal alignment. Finally, it is to be noted that because of the considerable height of the functionally single thickness screed plate 38 above the stakes 42, there is no danger of the concrete pavement wearing to such an extent below grade level that the upper ends of the stakes will become exposed.

Under certain circumstances it may be found desirable first to make the initial concrete pour in order to produce the slabs 26 and then, after permitting the concrete to harden, to remove the entire divider strip and its stakes before making the second pour in order to produce the slab 28. However, the cost of the divider strip 10 and its associated stakes 42 is sufficiently low that economy may be attained by leaving the strip and stakes in situ for permanent embedment in the concrete installation. The upper screed section 14 of the divider strip 10 is for all intents and purposes of single thickness and because of this the strip as a whole is comparatively light in weight and also being produced or fabricated at a lower cost than a conventional divider strip with a double thickness screed section.

The invention is not to be limited to the exact arrangement of parts shown in the accompanying drawings or described in this specification as various changes in the details of construction may be made without departing from the spirit or scope of the invention. Therefore, only insofar as the invention is particularly pointed out in the accompanying claims is the same to be limited.

Having thus described the invention what I claim as new and desire to secure by Letters Patent is:

1. A forming unit adapted to establish a key-joint between a pair of adjacent concrete slabs, and comprising, in combination, a plurality of horizontally aligned and spaced stakes set with their upper ends positioned uniformly and appreciably below the grade level which is to be established by the upper surfaces of the slabs, and a horizontally elongated divider strip formed of sheet metal, supported on said stakes and bridging the distance between each pair of adjacent stakes, said divider strip having a lower key-joint forming section and an upper substantially planar vertical screed section, said lower section including upper and lower vertical coplanar parts abutting the stakes on one side thereof, and an intermediate laterally offset key deformation portion extending between and connecting said upper and lower coplanar parts, the upper edge of said upper part of said lower key-forming section being provided with a narrow laterally turned flange extending in a direction opposite to that of the key deformation portion, the distal edge of said laterally turned flange being provided with an integral downturned flange, said downturned flange, together with the laterally turned flange and said upper planar part, defining a downwardly opening stake-receiving channel into which the upper ends of the stakes project, the lower edge of said downturned flange being provided with an integral upward fold which establishes said upper vertical screed section and renders the latter for the most part of single thickness, the lateral extent of said laterally turned flange on the upper edge of said upper planar part being substantially equal to the thickness of the upper ends of said stakes whereby such ends are received within said downwardly opening stake-receiving channel with a snug frictional fit, and whereby flexing of said screed section in the direction of the key deformation portion will serve to widen the channel to facilitate entry of the upper ends of said stakes into said channel.

2. A forming unit as set forth in claim 1 and wherein the extreme upper edge portion of the screed section is folded back so that, in effect, it provides a double thickness longitudinal rib for reinforcing and strengthening purposes.

* * * * *